US005897016A

United States Patent [19]

Wheaton

[11] Patent Number: 5,897,016

[45] Date of Patent: Apr. 27, 1999

[54] CONTAINER FOR PRESSURIZED FLUIDS

[75] Inventor: Christopher Simon Courtenay Wheaton, Hereford, United Kingdom

[73] Assignee: Keg Services Limited, United Kingdom

[21] Appl. No.: 08/737,021

[22] PCT Filed: Apr. 20, 1995

[86] PCT No.: PCT/GB95/00890

§ 371 Date: Oct. 31, 1996

§ 102(e) Date: Oct. 31, 1996

[87] PCT Pub. No.: WO95/30585

PCT Pub. Date: Nov. 16, 1995

[30] Foreign Application Priority Data

May 10, 1994 [GB] United Kingdom ..... 9409322

[51] Int. Cl.[6] ..... B65D 7/00

[52] U.S. Cl. ..... 220/581; 220/4.05; 220/4.21

[58] Field of Search ..... 220/652, 654, 220/581, 4.21, 4.24, 4.05, 669, 672, 4.13, 4.14, 4.04

[56] References Cited

U.S. PATENT DOCUMENTS

| | | | |
|---|---|---|---|
| 2,787,397 | 4/1957 | Radford | 220/4.21 X |
| 3,609,849 | 10/1971 | Krol . | |
| 3,780,899 | 12/1973 | Roper | 220/4.04 |
| 3,934,747 | 1/1976 | Needt | 220/4.05 |
| 4,396,442 | 8/1983 | Nakamura et al. . | |
| 4,932,546 | 6/1990 | Stannard | 220/581 |
| 5,104,458 | 4/1992 | Sunstedt et al. . | |
| 5,167,067 | 12/1992 | Sunstedt et al. . | |
| 5,323,953 | 6/1994 | Adderley et al. | 220/581 X |
| 5,564,587 | 10/1996 | Falk et al. | 220/581 X |

FOREIGN PATENT DOCUMENTS

| | | |
|---|---|---|
| 0374116 | 6/1990 | European Pat. Off. . |
| 0464780 | 1/1992 | European Pat. Off. . |
| 1123250 | 2/1962 | Germany . |
| 3049232 | 7/1982 | Germany . |
| 1139816 | 1/1969 | United Kingdom . |

OTHER PUBLICATIONS

English translation of German Patent No. DE 3049232.
English translation of German Patent 1 123 250.

*Primary Examiner*—Steven M. Pollard
*Attorney, Agent, or Firm*—Andrus, Sceales, Starke & Sawall

[57] ABSTRACT

A keg (10) for a pressurized fluid is formed of a main body part (11), to respective open ends of which are secured upper and lower ends parts (14, 12), each of the three parts being an injection moulding of thermoplastics material and connected together by welding. Around an internal surface of the main body part (11) is an integral continuous planar flange (21) which serves to resits outwards pressure on the body when the keg is pressurized, in use, the flange defining a large central opening (22) in the interior of the keg. Ribs (25) are formed integrally with the internal body surface and flange, and extend around the flange between respective pairs of first openings (23) through the flange, smaller second openings (24) being aligned with, and disposed at the inner end of the respective ribs.

15 Claims, 1 Drawing Sheet

CONTAINER FOR PRESSURIZED FLUIDS

This invention relates to a container for pressurised fluid, particularly alcoholic beverages such as beer.

Presently beer kegs are formed of stainless steel or are of thermoplastics material, being produced by blow-moulding. Although easier and less expensive to produce than a stainless steel keg, a blow-moulded keg of thermoplastics material may have only a low working pressure and may be susceptible to a volume increase under pressurisation.

An object of the invention is to provide an improved container for pressurised fluid.

According to a first aspect of the invention, a container for pressurised fluid has a substantially closed, hollow body of thermoplastics material and on an internal surface of the body at least one inwardly extending member which resists outwards pressure on the body when said container is pressurised, in use.

According to a second aspect of the invention, a container for pressurised fluid has a substantially closed, hollow body formed of at least two parts secured together, each part being an injection moulding of thermoplastics material.

The invention will now be described, by way of example, with reference to the accompanying drawings, in which:

FIGS. 1 and 2 show a container for pressurised fluid which in the particular application to which the invention is directed, is in the form of a keg 10 for receiving pressurised alcoholic beverages, such as beer.

Figure 1:
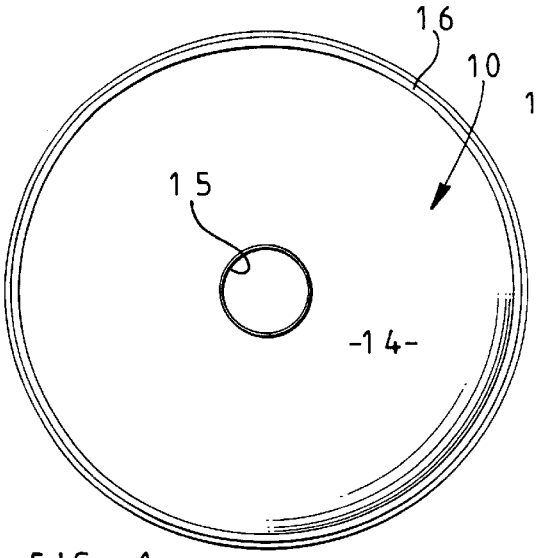
FIG. 1 is a plan view of a pressurised fluid container of the invention.
Figure 2:
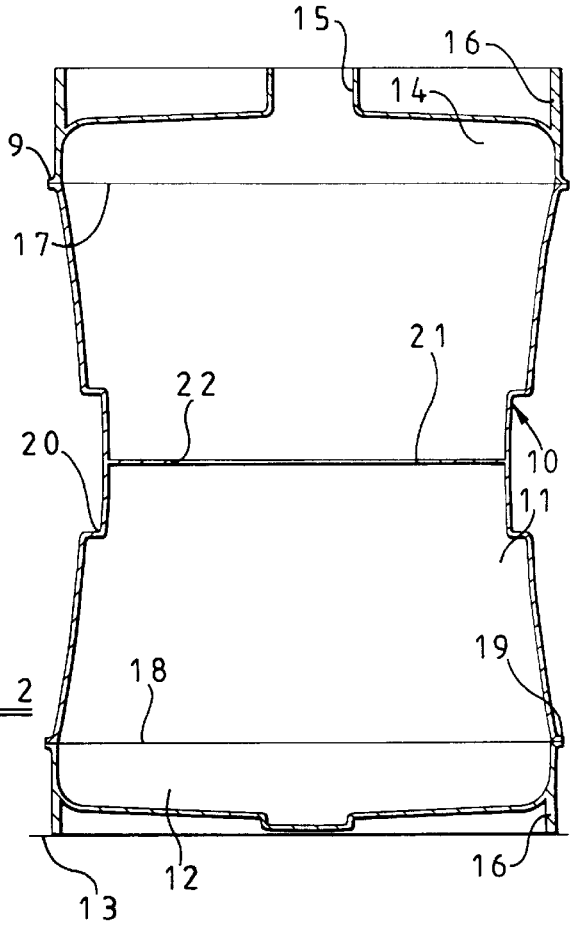
FIG. 2 is a vertical sectional view through the container.

In the embodiment illustrated in FIGS. 1 and 2, the keg is generally circular i n cross-section, and is made up of a central, main part 11, which is open at its opposite ends, a closed lower end part 12, which, as shown in FIG. 2, forms a bottom of the keg which rests on a surface 13, and an upper end part 14 which has a central circular opening 15 which can be closed by a bung or the like as required. It can be seen that both end parts have an integral outer cylindrical enclosure 16 therearound, the end of each of which extends to terminate flush with or slightly beyond the outermost extent of the centre of the end part, so that by means of the cylindrical enclosures, the keg can be stood upright on the surface 13 either as shown in FIG. 2 or turned the other way up.

The main part 11, and each of t he end parts 12,14, are, in this embodiment, injection mouldings of thermoplastics material, the parts being joined together as described and shown in FIG. 2, by welding at weld lines 17, 18 respectively. Thus the keg is formed as a substantially closed, hollow body, with liquid passing into and out of the interior of the keg by way of the opening 15. As shown in FIG. 2, means for manipulating the keg are shown at the outside of the keg body at the weld lines 17 and 18, these means being denoted by the numeral 19. Moreover mid-way between its ends, the central, main part 11 of the keg body is formed with an indent 20 which extends continuously therearound to enable the keg to be used in palletless handling systems. Instead of being continuous, a number of separate, spaced indents could be provided.

Preferably the host thermoplastics material used to manufacture the keg would be a polypropylene, with this possibly being either a homopolymer or a co-polymer. The overall mechanical properties of the keg would preferably be achieved by the thermoplastics material being glass-reinforced, with additional glass-reinforcing in critical areas.

The central, main part 11, is symmetrical about its central longitudinal axis, and it is also symmetrical about a central plane at right angles thereto. At this central plane, there is integrally formed on the interior surface of the part 11 a planar diaphragm or flange 21 which is schematically shown in FIG. 2.

This central flange is one form of a member disposed on the interior surface of the body of the keg which extends inwardly therefrom to resist outwards pressure on the body when, in use, the keg is pressurised. The member or members resisting such pressure can take many various forms, but the provision of a continuous form of the member around the interior surface of the central, main part of the keg is particularly advantageous, this member being at 90° to the longitudinal axis of the keg. Generally the diaphragm or flange needs to be more than just a rim because it has to resist the hoop stress which is trying to burst the container, when it is pressurised in use. To provide the necessary resistance to liquid pressure, the flange would normally be rigid or substantially so.

Figure 3:
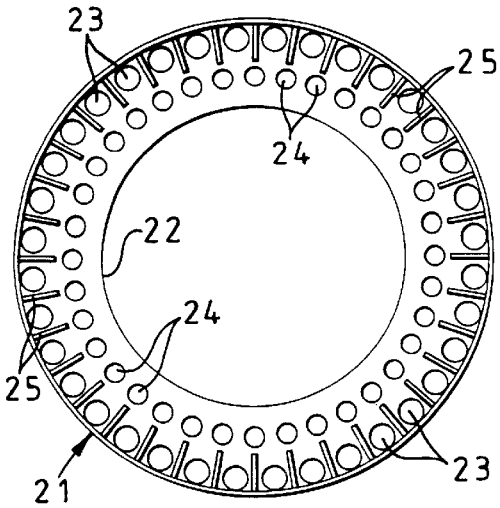
FIG. 3 shows one form of diaphragm of the container.
Figure 4:
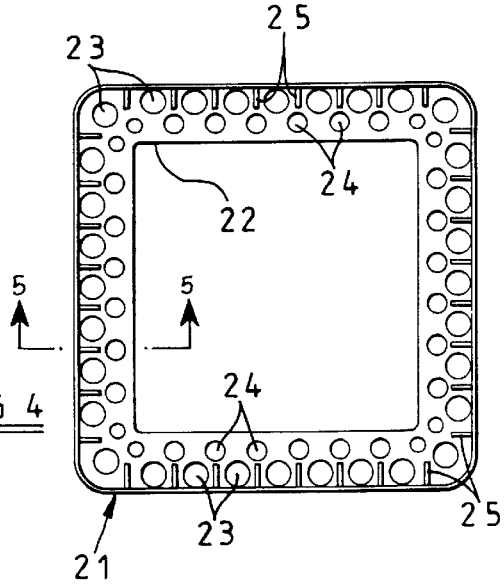
FIG. 4 shows the same form of diaphragm as in FIG. 3, but for a square container.

FIG. 3 shows one example of a possible form of diaphragm or flange for a cylindrical container, such as that shown in FIG. 2. It can be seen that there is a large central opening 22, through which, in use, an extractor tube would pass. It can be seen that the annular flange is provided with a first ring of spaced, identically sized circular openings 23 adjacent the junction between the flange and the main body part 11, and a concentric but inwardly spaced second ring of spaced identically sized smaller diameter circular openings 24, the openings 24 being disposed slightly radially inwardly from the free periphery of the flange. FIG. 4 shows the same form of flange, but for a rectangular keg, where the junctions between the four sides are rounded.

Figure 5:
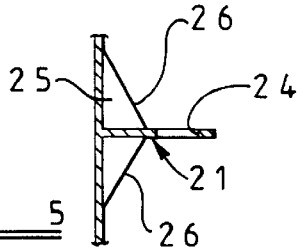
FIG. 5 is an enlarge d section on line 5—5 of FIG. 4.

With both the FIG. 3 and the FIG. 4 example, it can be seen that at the integral connection between the flange and the keg body there is provided a ring of stiffening ribs 25, each rib extending from the flange to respective opposite sides thereof. As can be seen from FIG. 5, each stiffening rib is of generally triangular shape thus providing a sloping edge 26 from the interior wall of the keg to the flange 21. As can be seen from FIGS. 3 and 4, each rib is disposed between a pair of the openings 23, and in the particular configuration shown in FIGS. 3 and 4, the openings 24 are offset relative to the openings 23, so that an opening 24 is disposed centrally in the plane of each rib 25. The flange thus acts as a platform from which the stiffening ribs emanate into the side wall of the main part 11 of the keg, thereby extending the stiffening effect of this central flange away from its immediate position. Preferably the diaphragm/flange and associated stiffening ribs are moulded in the same process as the main part 11 and thus all these parts are formed of the same thermoplastics material. However the flange and/or the stiffening ribs could be subject to local reinforcement, such as glass reinforcing in critical areas. Ribs could be provided without the provision of openings in the flange, or vice versa.

It is considered that one aspect of the invention relates to the formation of the keg by the use of at least two parts secured together, each part being an injection moulding of the thermoplastics material. It is considered that another aspect of the invention relates to the provision on the interior of a hollow body of thermoplastics material of at least one inwardly extending member which, when the container is pressurised in use, resists outwards pressure on the body.

Thus in the first aspect the provision of the flange or the like is inessential, whilst in the second aspect the body may or may not be formed in at least two separate parts and may or may not be formed by injection moulding. However the preferred form of container is that shown in the drawings where at least two injection moulded parts are secured together to form the container with their being a member in the interior to resist any tendency for the container to burst when pressurised. Such a container of this form will perform the same function as a stainless steel beer keg even though it is of (injection moulded) thermoplastics material.

Unlike blow-moulded containers, such a keg will have a working pressure in excess of approximately three bars and will not show any significant increase in volume when pressurised to that level. The ability of the container to withstand high internal pressure is enhanced by the use of the central perforated diaphragm/flange.

The openings 23 and 24 around the inner and outer peripheries of the flange enable liquid to flow past the flange when the container is laid on its side, as would be the case in dispensing cask conditioned ale (Real ale). It will however be appreciated that the number, size and arrangement of openings in the flange, as well as the number, position and shape of the stiffening ribs can be different from what is shown in FIGS. 3 and 4. Additionally the flange need not be continuous around the interior surface of either the part 11 or the parts 12 and 14, and even if provided as a continuous flange, more than one flange could be provided in one or more of the component parts of the keg body. The resistance to outwards pressure on the body could be in the form of one or more diametral or generally diametral struts extending between respective opposite internal surface portions of the body, but, with a plurality of struts, sufficient open area defined between them to allow flow of liquid. For example two such struts at 90° to one another could meet at a central circular area, which could have openings therethrough to allow flow of liquid through said area.

I claim:

1. A container for pressurized fluid, in the form of a substantially closed, hollow body of thermoplastics material, said body comprising a one-piece main body part having on its internal surface at least one inwardly extending planar member, said inwardly extending member being rigid or substantially rigid, extending continuously around the internal surface of said one-piece main body part, formed integrally therewith, to resist outwards pressure on the body when the container is pressurized, in use, and having a free inner edge within the interior of the main body part.

2. A container according to claim 1, wherein the inwardly extending member comprises a flange defining a large central opening in the interior of said main body part.

3. A container according to claim 2, wherein said inwardly extending member is normal to a central rotational axis of the main body part.

4. A container according to claim 3, wherein said inwardly extending member lies in a plane normal to a longitudinal axis of the container, about which plane the main body part is symmetrical.

5. A container according to claim 4, wherein the exterior of the main body part has indent means extending to opposite sides of the plane.

6. A container according to claim 1, wherein at least one rib is provided at the junction of said inwardly extending member and said internal surface of the main body part.

7. A container according to claim 6, wherein said rib is integral with said main body part and said inwardly extending member.

8. A container according to claim 6, wherein a multiplicity of ribs is provided and said inwardly extending member is provided with a multiplicity of openings for fluid flow, the ribs being disposed between adjacent pairs of said openings.

9. A container according to claim 8, wherein said inwardly extending member is provided with a multiplicity of further openings for fluid flow, said further openings being aligned with the ribs respectively in the inwards direction of the main body part.

10. A container according to claim 8, wherein the main body part is an injection molding of said thermoplastics material.

11. A container to claim 10, wherein respective upper and lower end parts are secured to opposite ends of the main body portion, the end portion each having an injection molding of thermoplastics material.

12. A container according to claim 11, wherein the end parts are each secured to the main body portion by welding.

13. A container according to claim 1, wherein said inwardly extending member is provided with a multiplicity of openings for fluid flow therethrough.

14. A container according to claim 1, which is of circular cross-section.

15. A container according to claim 1, wherein the thermoplastics material is glass-reinforced.

* * * * *